US011292114B2

(12) United States Patent
Pedicini et al.

(10) Patent No.: US 11,292,114 B2
(45) Date of Patent: Apr. 5, 2022

(54) FASTENER DRIVING APPARATUS

(71) Applicant: Tricord Solutions, Inc., Franklin, TN (US)

(72) Inventors: Christopher Pedicini, Franklin, TN (US); John Witzigreuter, Canton, GA (US)

(73) Assignee: TRICORD SOLUTIONS, INC., Franklin, TN (US)

( * ) Notice: Subject to any disclaimer, the term of this patent is extended or adjusted under 35 U.S.C. 154(b) by 131 days.

(21) Appl. No.: 16/674,813

(22) Filed: Nov. 5, 2019

(65) Prior Publication Data

US 2020/0061788 A1 Feb. 27, 2020

Related U.S. Application Data

(63) Continuation-in-part of application No. 16/168,827, filed on Oct. 24, 2018, now abandoned.

(60) Provisional application No. 62/803,939, filed on Feb. 11, 2019, provisional application No. 62/621,044, filed on Jan. 24, 2018.

(51) Int. Cl.

| | |
|---|---|
| ***B25C 1/04*** | (2006.01) |
| *B25C 1/00* | (2006.01) |
| *B25C 1/06* | (2006.01) |

(52) U.S. Cl.

CPC ..... *B25C 1/047* (2013.01); *B25C 1/008* (2013.01); *B25C 1/06* (2013.01)

(58) Field of Classification Search

CPC .. B25C 1/06; B25C 1/04; B25C 1/047; B25C 5/13

See application file for complete search history.

(56) References Cited

U.S. PATENT DOCUMENTS

| | | | | |
|---|---|---|---|---|
| 6,093,128 | A * | 7/2000 | Seith | B25B 21/00 173/216 |
| 9,539,714 | B1 * | 1/2017 | Pedicini | B25C 1/04 |
| 9,962,821 | B2 * | 5/2018 | Pedicini | B25C 1/06 |
| 10,695,899 | B2 * | 6/2020 | Scott | B25C 1/041 |
| 10,751,865 | B2 * | 8/2020 | Pedicini | B25D 11/10 |
| 10,946,504 | B1 * | 3/2021 | Pedicini | B25C 1/047 |
| 2006/0180631 | A1 * | 8/2006 | Pedicini | B25C 1/06 227/130 |
| 2016/0096259 | A1 * | 4/2016 | Pedicini | B25C 1/047 227/146 |
| 2017/0100829 | A1 * | 4/2017 | Pedicini | B25C 1/047 |
| 2017/0274513 | A1 * | 9/2017 | Pedicini | B25C 1/06 |

(Continued)

*Primary Examiner* — Andrew M Tecco

(74) *Attorney, Agent, or Firm* — Xsensus LLP

(57) ABSTRACT

A fastener driving apparatus comprises at least one gas spring or spring, a drive mechanism, an anvil assembly, and an anvil. The drive mechanism selectively engages one of the at least one gas spring, spring or anvil assembly. A locking mechanism (such as a one-way clutch) is used to provide a middle stopping point during which the gas spring(s) is/are being energized. The motor of the apparatus may thereafter be turned off. When the user is ready to fire a nail, the motor is re-energized and the drive mechanism continues, releasing the gas spring(s) to drive the nail. The drive mechanism may include its own one-way clutch for overrunning and causing the drive mechanism to be released from the locking mechanism. To complete, the cycle the crank continues rotation and re-engages the anvil assembly and energizes the gas spring(s).

14 Claims, 6 Drawing Sheets

(56) References Cited

U.S. PATENT DOCUMENTS

| | | | | |
|---|---|---|---|---|
| 2017/0355069 | A1* | 12/2017 | Scott | B25C 1/047 |
| 2017/0361444 | A1* | 12/2017 | Namouz | B25C 1/06 |
| 2018/0001461 | A1* | 1/2018 | Pedicini | B25C 1/047 |
| 2018/0126527 | A1* | 5/2018 | Pomeroy | B25C 1/008 |

* cited by examiner

FASTENER DRIVING APPARATUS

CROSS REFERENCE TO RELATED APPLICATIONS

The present disclosure claims priority under 35 United States Code, Section 119 on the U.S. Provisional Patent Application Ser. No. 62/803,939, filed on Feb. 11, 2019, the disclosure of which is incorporated by reference. The present disclosure also is a continuation-in-part and claims priority under 35 United States Code, Section 120 on the U.S. Non-Provisional patent application Ser. No. 16/168,827 filed on Oct. 24, 2018, the disclosure of which is incorporated by reference.

FIELD OF THE DISCLOSURE

The present disclosure relates to fastener driving apparatuses, and, more particularly, to such fastener or staple driving mechanisms that require operation as a hand tool.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices and means of driving fasteners into wood. These power-assisted means of driving fasteners can be either in the form of finishing fastener systems used in baseboards or crown molding in house and household projects, or in the form of common fastener systems that are used to make walls or hang sheathing onto same. These systems can be portable (i.e., not connected or tethered to an air compressor or wall outlet) or non-portable.

The most common fastener driving apparatus uses a source of compressed air to actuate a guide assembly to push a fastener into a substrate. For applications in which portability is not required, this is a very functional system and allows rapid delivery of fasteners for quick assembly. A disadvantage is that it does however require that the user purchase an air compressor and associated air-lines in order to use this system. A further disadvantage is the inconvenience of the device being tethered (through an air hose) to an air compressor.

To solve this problem, several types of portable fastener drivers operate off of fuel cells. Typically, these guns have a guide assembly in which a fuel is introduced along with oxygen from the air. The subsequent mixture is ignited with the resulting expansion of gases pushing the guide assembly and thus driving the fastener into the workpieces. This design is complicated and is far more expensive then a standard pneumatic fastener gun. Both electricity and fuel are required as the spark source derives its energy typically from batteries. The chambering of an explosive mixture of fuel, the use of consumable fuel cartridges, the loud report and the release of combustion products are all disadvantages of this solution. Systems such as these are already in existence and are sold commercially to contractors under the Paslode™ name.

Another commercially available solution is a fastener gun that uses electrical energy to drive a stapler or wire brad. Such units typically use a solenoid to drive the fastener (such as those commercially available under the Arrow™ name or those which use a ratcheting spring system such as the Ryobi™ electric stapler). These units are limited to short fasteners (typically 1" or less), are subject to high reactionary forces on the user and are limited in their repetition rate. The high reactionary force is a consequence of the comparatively long time it takes to drive the fastener into the substrate. Additionally, because of the use of mechanical springs or solenoids, the ability to drive longer fasteners or larger fasteners is severely restricted, thus relegating these devices to a limited range of applications. A further disadvantage of the solenoid driven units is they often must be plugged into the wall in order to have enough voltage to create the force needed to drive even short fasteners.

A final commercially available solution is to use a flywheel mechanism and clutch the flywheel to an anvil that drives the fastener. Examples of such tools can be found under the Dewalt™ name. This tool is capable of driving the fasteners very quickly and in the longer sizes. The primary drawback to such a tool is the large weight and size as compared to the pneumatic counterpart. Additionally, the drive mechanism is very complicated, which gives a high retail cost in comparison to the pneumatic fastener gun.

Clearly based on the above efforts, a need exists to provide portable solution to driving fasteners which is unencumbered by fuel cells or air hoses. Additionally, the solution ought to provide a low reactionary feel, be able to drive full size fasteners and be simple, cost effective and robust in operation.

The prior art teaches several additional ways of driving a fastener or staple. The first technique is based on a multiple impact design. In this design, a motor or other power source is connected to an impact anvil through either a lost motion coupling or other device. This allows the power source to make multiple impacts on the fastener to drive it into the workpiece. The disadvantages in this design include increased operator fatigue since the actuation technique is a series of blows rather than a single drive motion. A further disadvantage is that this technique requires the use of an energy absorbing mechanism once the fastener is seated. This is needed to prevent the anvil from causing excessive damage to the substrate as it seats the fastener. Additionally, the multiple impact designs are not very efficient because of the constant motion reversal and the limited operator production speed.

A second design that is taught in U.S. Pat. Nos. 3,589,588, 5,503,319, and 3,172,121 includes the use of potential energy storage mechanisms (in the form of a mechanical spring). In these designs, the spring is cocked (or activated) through an electric motor. Once the spring is sufficiently compressed, the energy is released from the spring into the anvil (or fastener driving piece), thus pushing the fastener into the substrate. Several drawbacks exist to this design. These include the need for a complex system of compressing and controlling the spring, and in order to store sufficient energy, the spring must be very heavy and bulky. Additionally, the spring suffers from fatigue, which gives the tool a very short life. Finally, metal springs must move a significant amount of mass in order to decompress, and the result is that these low-speed fastener drivers result in a high reactionary force on the user.

To improve upon this design, an air spring has been used to replace the mechanical spring. U.S. Pat. No. 4,215,808 teaches of compressing air within a guide assembly and then releasing the compressed air by use of a gear drive. This patent overcomes some of the problems associated with the mechanical spring driven fasteners described above, but is subject to other limitations. One particular troublesome issue with this design is the safety hazard in the event that the anvil jams on the downward stroke. If the fastener jams or buckles within the feeder and the operator tries to clear the jam, he is subject to the full force of the anvil, since the anvil is predisposed to the down position in all of these types of devices. A further disadvantage presented is that the fastener must be fed once the anvil clears the fastener on the backward stroke. The amount of time to feed the fastener is limited and can result in jams and poor operation, especially with longer fasteners. A further disadvantage to the air spring results from the need to have the ratcheting mechanism as part of the anvil drive. This mechanism adds weight and causes significant problems in controlling the fastener drive since the weight must be stopped at the end of the stroke. This added mass slows the fastener drive stroke and increases the reactionary force on the operator. Additionally, because significant kinetic energy is contained within the air spring and piston assembly the unit suffers from poor efficiency. This design is further subject to a complicated drive system for coupling and uncoupling the air spring and ratchet from the drive train which increases the production cost and reduces the system reliability.

U.S. Pat. No. 5,720,423 again teaches of an air spring that is compressed and then released to drive the fastener. The drive or compression mechanism used in this device is limited in stroke and thus is limited in the amount of energy which can be stored into the air stream. In order to provide sufficient energy in the air stream to achieve good performance, this patent teaches use of a gas supply which preloads the guide assembly at a pressure higher than atmospheric pressure. Furthermore, the compression mechanism is bulky and complicated. In addition, the timing of the motor is complicated by the small amount of time between the release of the piston and anvil assembly from the drive mechanism and its subsequent re-engagement. Additionally, U.S. Pat. No. 5,720,423 teaches that the anvil begins in the retracted position, which further complicates and increases the size of the drive mechanism. Furthermore, because of the method of activation, these types of mechanisms as described in U.S. Pat. Nos. 5,720,423 and 4,215,808 must compress the air to full energy and then release off the tip of the gear while under full load. This method of compression and release causes severe mechanism wear. As will be discussed below, the present disclosure overcomes these and other limitations in the prior art use of air springs.

A third means for driving a fastener that is taught includes the use of flywheels as energy storage means. The flywheels are used to clutch a hammering anvil that impacts the fastener. This design is described in detail in U.S. Pat. Nos. 4,042,036, 5,511,715, and 5,320,270. One major drawback to this design is the problem of coupling the flywheel to the driving anvil. This prior art teaches the use of a friction clutching mechanism that is both complicated, heavy and subject to wear. Further limiting this approach is the difficulty in controlling the energy in the fastener system. The mechanism requires enough energy to drive the fastener, but retains significant energy in the flywheel after the drive is complete. This further increases the design complexity and size of such prior art devices.

A fourth means for driving a fastener is taught in the present inventors' U.S. Pat. No. 8,079,504, which uses a compression on demand system with a magnetic detent. This system overcomes many of the advantages of the previous systems but still has its own set of disadvantages which include the need to retain a very high pressure for a short period of time. This pressure and subsequent force necessitate the use of high strength components and more expensive batteries and motors.

A fifth means is taught in pending U.S. Pat. No. 8,733,610, which uses a vacuum to drive a fastener drive assembly. This clearly has its own advantages over the previous systems but has its own set of disadvantages, including the need to retain a seal against air pressure. This sealing requirement necessitates the use of more accurate cylinders and pistons, thus contributing to the manufacturing cost.

All of the currently available devices suffer from one or more the following disadvantages:

- Complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.
- Poor ergonomics. The fuel powered mechanisms have loud combustion reports and combustion fumes. The multiple impact devices are fatiguing and are noisy. Non-portability. Traditional fastener guns are tethered to a fixed compressor and thus must maintain a separate supply line.
- High reaction force and short life. Mechanical spring driven mechanisms have high tool reaction forces because of their long fastener drive times. Additionally, the springs are not rated for these types of duty cycles leading to premature failure. Furthermore, consumers are unhappy with their inability seat longer fasteners or work with denser wood species.
- Safety issues. The prior art "air spring" and heavy spring driven designs suffer from safety issues for longer fasteners since the predisposition of the anvil is towards the substrate. During jam clearing, this can cause the anvil to strike the operators hand.
- The return mechanisms in most of these devices involve taking some of the drive energy. Either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving apparatus that overcomes these various disadvantages of the prior art, while still retaining the benefits of the prior art.

SUMMARY OF THE DISCLOSURE

In accordance with the present disclosure, a fastener driving apparatus is described which derives its power from an electrical source, preferably rechargeable batteries, and uses a motor to actuate a spring (such as one or more gas springs, for example). After sufficient movement of piston(s) in the gas spring(s), the piston(s) of the gas spring(s) commence movement, accelerating an anvil and/or anvil assembly. The gas spring(s) of the present disclosure may contain air, for example, or, in another preferred embodiment, nitrogen. In an embodiment, the piston is connected to the anvil. A crank and pulley system may cause the anvil and piston to move, compressing and energizing the spring(s). Once the crank goes past bottom dead center, an overrunning clutch allows the crank to overrun the motor drive, creating a fast-acting release of the piston(s) and anvil to drive a fastener.

By using a gas spring, the present fastener driving assembly is able to generate sufficient energy to drive a fastener with only a small increase in pressure in the chamber or other environment in which the piston(s) is/are disposed.

This unexpectedly increased the efficiency of the unit since heat of compression of a gas is a significant source of energy inefficiency. (This aspect also reduced the size of the apparatus.)

During the inventive process, it was also discovered that the use of a crank and overrunning clutch significantly decreased the cycle time of the device. The time to go from bottom dead center to top dead center once the clutch over runs is around 5 milliseconds. During this time a fastener is driven. Once the crank passes top dead center the motor can be re engaged to start another cycle without any delay. This saves 30 to 100 milliseconds on the cycle time compared with other designs.

Another unexpected result was the high efficiency of the apparatus as compared to the vacuum-actuated fastener driver patent (U.S. Pat. No. 8,079,504) as seal friction loss is a major source of efficiency reduction. By limiting the diameter of the gas springs, the frictional loss of the seal was significantly reduced. This was a major unexpected benefit of the present disclosure, dramatically increasing the efficiency over the prior art. For instance, test results show conversion efficiencies (potential energy to kinetic energy in the drive anvil) of over 80%, which is far better than the 65% obtained by the apparatus of the '504 patent.

The fastener driving cycle of the apparatus disclosed herein may start with an electrical signal, after which a circuit connects a motor to the electrical power source. The motor is coupled to the gas spring or springs through a drive mechanism. In an operational cycle of the drive mechanism, the mechanism alternatively (1) actuates the piston(s) of the gas spring(s) and (2) releases the piston(s) to seat a fastener. For example, during a portion of its cycle, the drive mechanism may move the piston(s) to increase potential energy stored within the gas spring(s). In the next step of the cycle, the mechanism overruns to allow the accumulated potential energy within the gas spring(s) to act on and actuate the piston(s). The piston(s) thereupon move and cause the anvil assembly to move and drive a fastener. In an embodiment, at least one bumper is disposed outside the gas spring(s) to reduce the wear on the piston(s) and anvil assembly. Another unexpected result was the ability to eliminate the bumper required in the gas spring. By not detaching the anvil assembly from the piston(s) only one bumper is required.

In an embodiment, a sensor and a control circuit are provided for determining at least one position of the gas spring(s), drive mechanism, anvil and/or anvil assembly. The sensor may provide for enabling the proper timing for stopping the operational cycle of the apparatus. Further, this information can be used to detect a jam condition for proper recovery.

In an embodiment, the apparatus comprises more than one gas spring. In an exemplary embodiment, two gas springs are utilized, each of which spring may be disposed on opposite sides of the anvil assembly. This configuration results in a more compact fastener driving device as the gas springs are able to be nested in parallel with the anvil assembly instead of in series one of top of the other. Another benefit is that the use of more than one gas spring allows for a smaller diameter piston, as the force required to actuate the piston is distributed over two gas/air springs. A smaller diameter piston is advantageous as seal friction is reduced and guiding of the piston is improved, as length of the required guiding bushing is reduced.

In an embodiment, a locking mechanism (such as a one-way clutch) is used to provide a middle stopping point during which the gas spring(s) is/are being energized. This locking mechanism retains the drive mechanism in place once power is removed from the motor. This allows potential energy to be stored in the fastener driving apparatus. It also greatly reduces the time needed to fire a fastener from cycle start to nail drive. The locking mechanism further greatly reduces the time needed to fire the first fastener as the mechanism needs only to traverse a short distance before the anvil and/or anvil assembly is released.

Accordingly, and in addition to the objects and advantages of the portable electric fastener gun as described above, several objects and advantages of the present disclosure are:

- To provide a simple design for driving fasteners that has a significantly lower production cost than currently available nail guns and that is portable and does not require an air compressor.
- To provide a fastener driving device that mimics the pneumatic fastener performance without a tethered air compressor.
- To provide an electrical driven high power fastening device that has very little wear.
- To provide a more energy efficient mechanism for driving nails than is presently achievable with a compressed air design.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present disclosure will become better understood with reference to the following detailed description and claims taken in conjunction with the accompanying drawings, in which like reference numerals refer to like parts throughout the description of several views of the drawings, and in which

DETAILED DESCRIPTION OF THE DISCLOSURE

The best mode for carrying out the present disclosure is presented in terms of its preferred embodiment, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure. Furthermore, although the following relates substantially to one embodiment of the design, it will be understood by those familiar with the art that changes to materials, part descriptions and geometries can be made without departing from the spirit of the disclosure. It is further understood that references such as front, back or top dead center, bottom dead center do not refer to exact positions but approximate positions as understood in the context of the geometry in the attached figures.

The terms "a" and "an" herein do not denote a limitation of quantity, but rather denote the presence of at least one of the referenced items.

Figure 1:
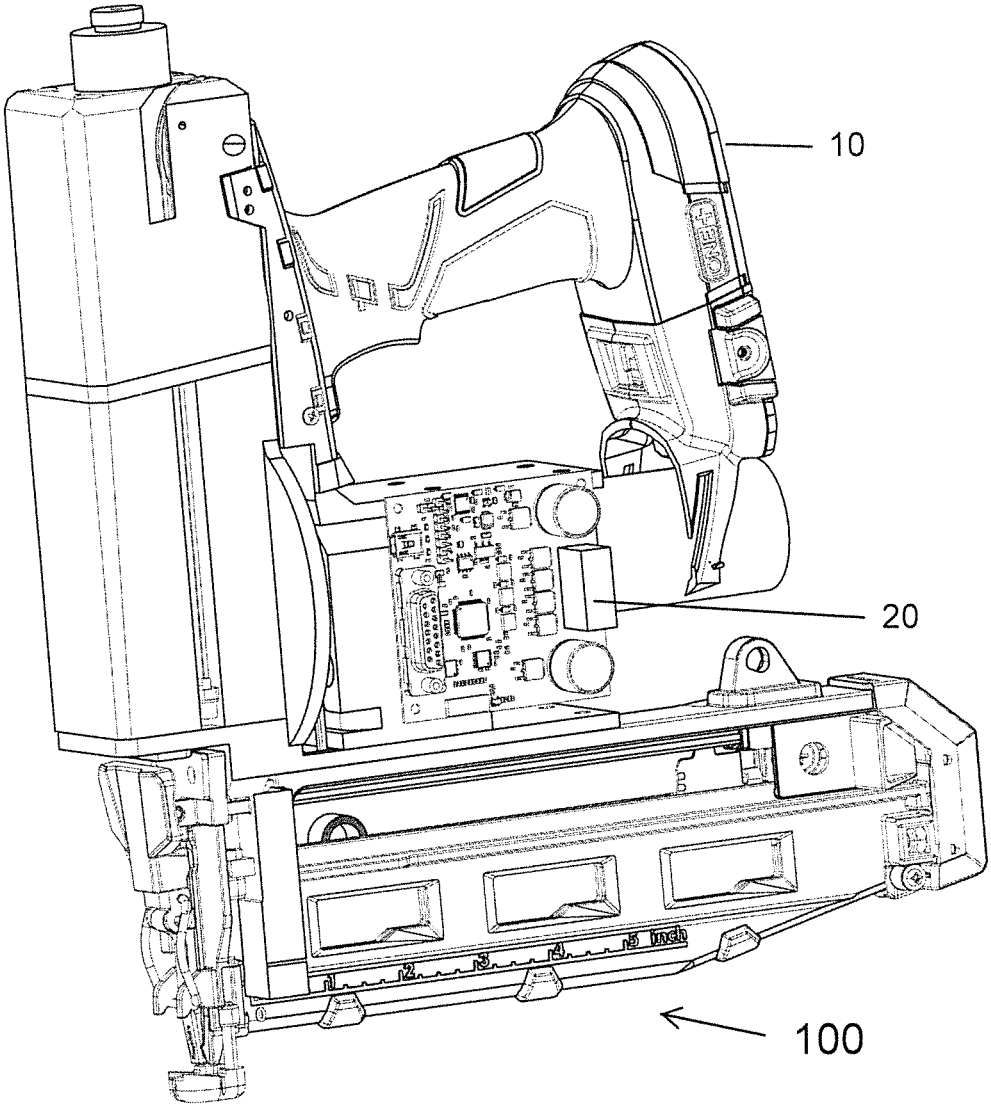
FIG. 1 shows a perspective view of a fastener driving apparatus, in accordance with an exemplary embodiment of the present disclosure.
Figure 2:
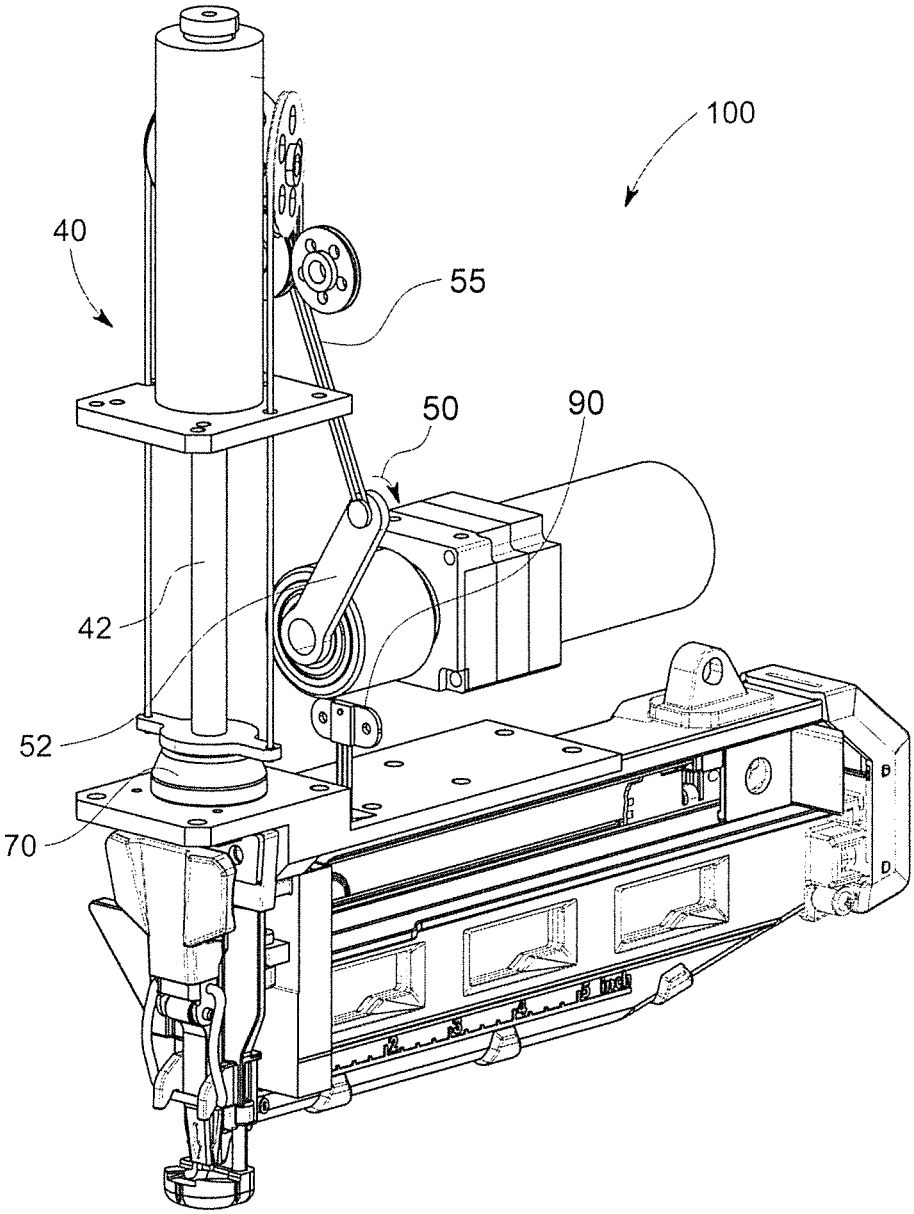
FIG. 2 shows components of a fastener driving apparatus, in accordance with an exemplary embodiment of the present disclosure.
Figure 3:
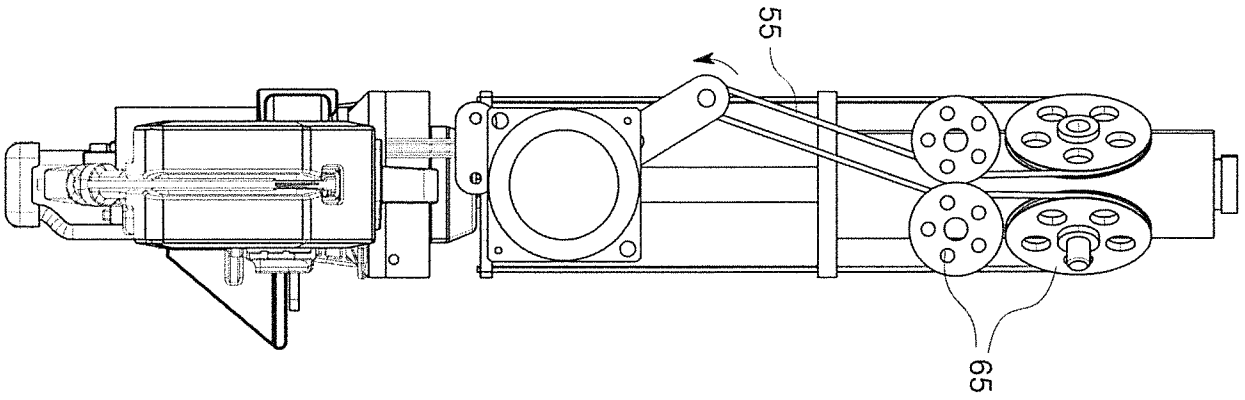
FIG. 3 shows a pulley and cable arrangement of a fastener driving apparatus, in accordance with an exemplary embodiment of the present disclosure.
Figure 4:
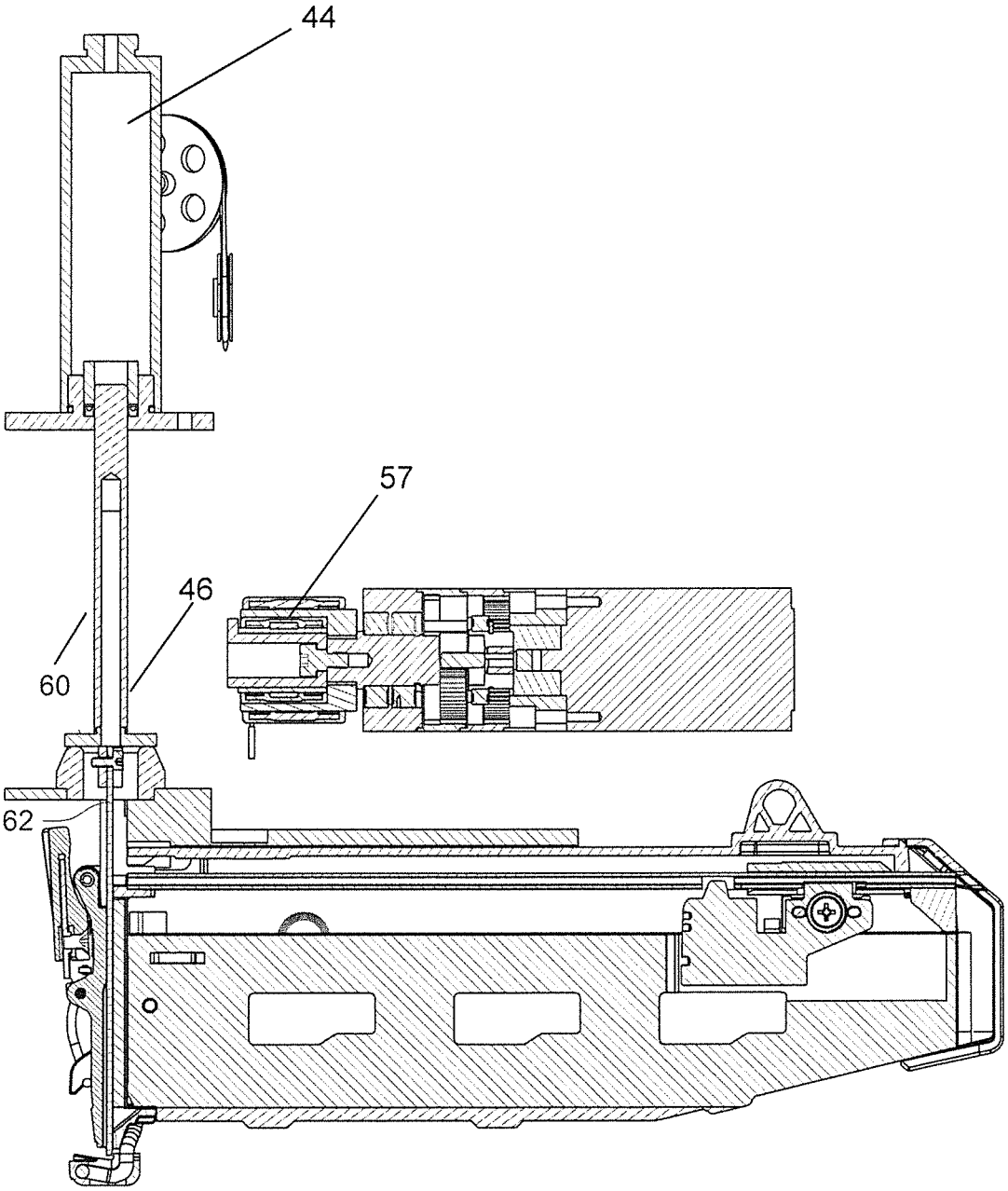
FIG. 4 shows an anvil assembly of a fastener driving apparatus, in accordance with an exemplary embodiment of the present disclosure.

Referring also to the figures and FIG. 1 in particular, the present disclosure provides for a fastener driving apparatus 100. In an embodiment, and as shown in FIG. 2, for example, the apparatus 100 comprises a power source 10, a control circuit 20, a motor 30, at least one spring 40, a drive mechanism 50 with a crank 52, at least one one-way clutch 57, an anvil assembly 60 (as shown in FIG. 4 in an exemplary embodiment) including a piston 42, and an anvil 62. The apparatus 100 may further comprise at least one cable 55, as shown in FIGS. 2 and 3, or example. The at least one cable connects the crank 52 via pulleys 65 to the anvil assembly 60. In a preferred embodiment two cables are connected to the crank 52 on one end and then connected to either sides of the anvil assembly 60 on the other end. Pulleys 65 are used to direct the cables and allow for optimal placement of the crank 52 and drive mechanism 50.

Figure 5:
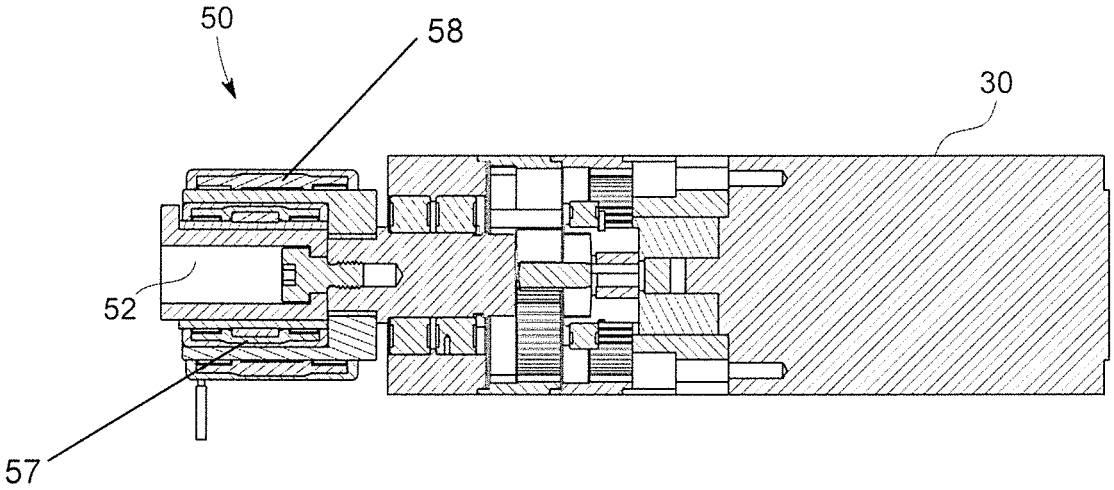
FIG. 5 shows a one-way clutch of a fastener driving apparatus, in accordance with an exemplary embodiment of the present disclosure.

The apparatus 100 may further comprise at least one bumper 70. The at least one bumper may be disposed within a gas spring and/or outside of a gas spring. The gas spring(s) 40 include a piston 42, which piston 42 is at least partially disposed within a sealed chamber 44, and which piston 42 is selectively actuated by the drive mechanism 50. The gas spring(s) 40 further comprise(s) a nose portion 46 (which nose portion may be a part of or coupled to the piston) and which nose portion 46 extends out of the chamber and which is connected to the anvil 62 and/or anvil assembly 60 during the operational cycle of the apparatus 100.

the drive mechanism 50 may comprise, in an embodiment (and shown in FIG. 5), at least one one-way clutch 57, and, in an embodiment, a series of one-way clutches, and a crank 52 connected to cables 55. It will be apparent that the drive mechanism 50 is configured to energize the gas spring 40 during the downward rotation of the crank 52 (as depicted in FIG. 2) and to release the gas spring 40 via a one-way clutch 57, to drive a fastener on the upward rotation of the crank 52. The drive mechanism 50 is operatively coupled to the anvil or anvil assembly 60 (which anvil assembly comprises the anvil 62 and the piston 42), or, in an particular embodiment, coupled to the piston 42 such that the drive mechanism 50 may alternate in actuating the piston 42 (during the crank downward rotation, for example, and as shown in FIGS. 2 and 3) and in refraining from applying a drive force on the piston. A second one-way clutch may be configured within the drive mechanism to allow the drive mechanism 50 to stop and retain the energized gas spring(s) prior to releasing the anvil assembly 60. In an embodiment, the one-way clutch may be a sprag clutch, an over running clutch, a roller clutch, a wrap spring, a spindle lock and a ratchet. It will be apparent that other devices for stopping and retaining the drive mechanism may be provided, such as a wrap spring or ratchet and pall arrangement. In a preferred embodiment, the drive mechanism 50 preferably acts directly upon the anvil assembly 60 through cables 55 to move the piston 42 to store potential energy (as described elsewhere herein.) Note that the cables 55 can be constructed of wire rope, Kevlar rope, carbon fiber rope, nylon, chain, and the like.

The apparatus may further comprise a means for balancing the forces on the cables when two or more cables are used. By using two stops and a slider connected to the cables the forces can be balanced during the entire rotation of the crank 52.

Figure 6:
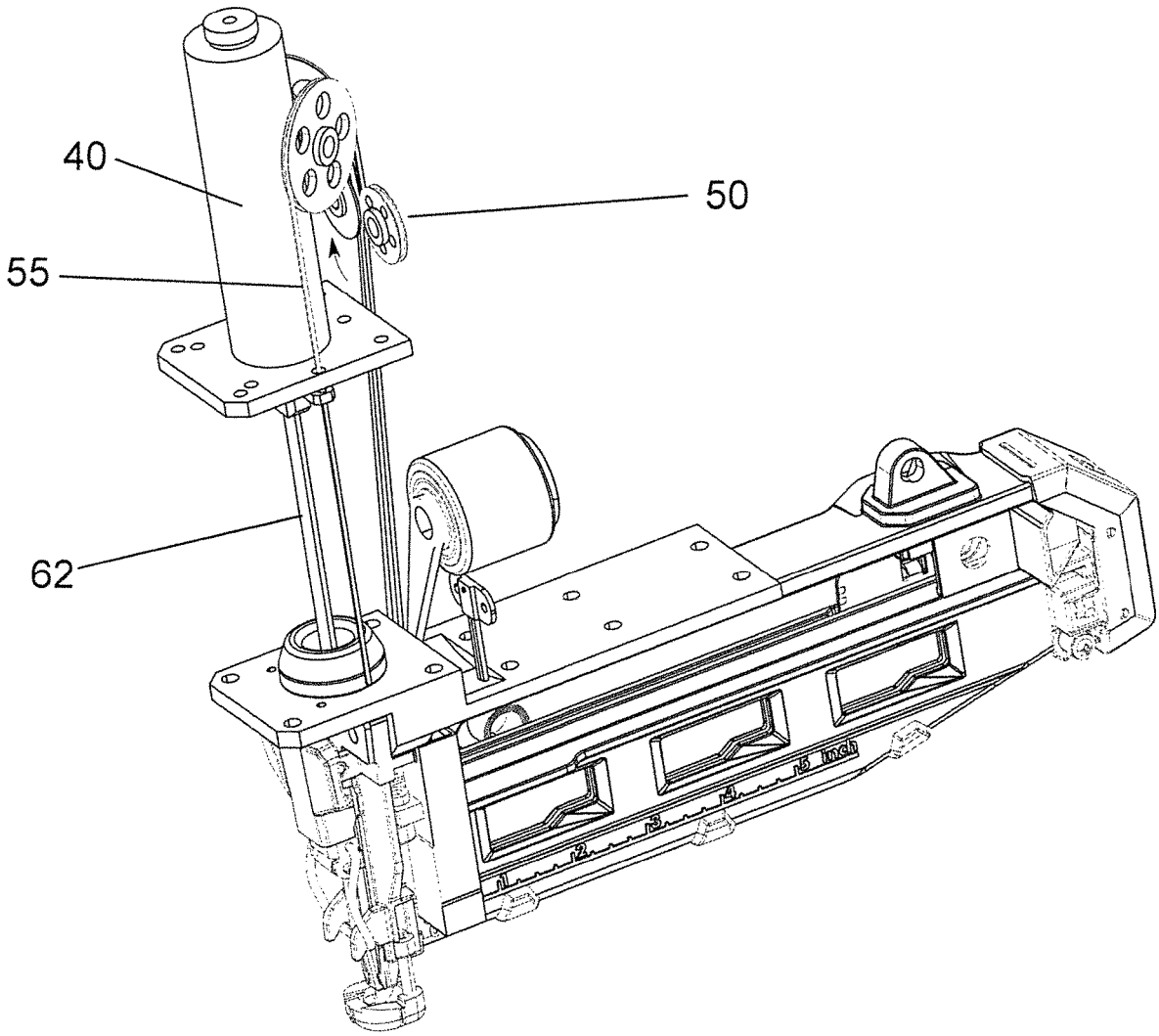
FIG. 6 shows a fastener driving apparatus in an energized position, in accordance with an exemplary embodiment of the present disclosure.

In an embodiment, the drive mechanism 50 engages and actuates the piston(s) 42 (and/or anvil assembly 60) to store potential energy within the gas spring(s) 40, which actuation of the piston(s) 42 may be referred to as an "energized position" of the piston(s) 42. An exemplary embodiment of such energized position is shown in FIG. 6.

In an embodiment, the initial pressure (before the drive mechanism 50 actuates the piston 42) within the gas spring 40 is at least 40 psia. The configuration and design of the gas spring 40 are such that the pressure increase during the piston movement is less than 30% of the initial pressure, and in an embodiment, less than 25% of the initial pressure, which allows the drive mechanism 50 to operate at a more constant torque, thus improving the motor efficiency. The gas spring(s) of the present disclosure comprise a rod and seal on said rod. Due to at least the rod seal configuration, the apparatus is able to achieve pressure within the gas spring or springs above 200 psi, which provides for more effective driving than the prior art nailers and fastener drivers. Furthermore, the rod seal configuration eliminates the need for a separate chamber that would otherwise enclose the gas spring(s) to achieve such low or small change in pressure during piston movement.

In exemplary embodiment of an operational cycle, the drive mechanism 50 thereafter disengages the piston(s) 42 (and/or anvil assembly 60), allowing potential energy to act on the piston(s) 42 and cause the piston(s) 42 to move and act on the anvil 62 and/or anvil assembly 60 (as will be described in further detail below). The drive mechanism 50 may thereafter again act on the piston(s) 42 (and/or anvil assembly 60) to again store potential energy within the gas spring(s) 40 and may thereafter again temporarily cease to act on the piston(s) 42 (and/or anvil assembly 60) to allow potential energy to instead act on the piston(s) 42.

The anvil 62 and/or anvil assembly 60 is operatively coupled to the gas spring(s) 40, such as to the piston(s) 42 or nose portion(s) such that when the piston(s) 42 is/are released under pressure from the drive mechanism 50, the force from the piston(s) 42 is imparted onto the anvil 62, causing the anvil 62 to move in a direction and to drive a fastener, for example. The anvil 62 may be operatively coupled to a guide, shaft, or other structure that limits and guides the range of motion of the anvil 62. To counteract cam loads or other drive mechanism loads on the anvil and/or anvil assembly, bearings (and preferably, roller bearings) may be provided in the guide, shaft, or other structure that limits the range of motion.

A sensor 90 may be provided for determining at least one position of the crank, gas spring(s), drive mechanism, anvil and/or anvil assembly. The sensor may enable the proper timing for stopping the operational cycle of the apparatus. Further, this information can be used to detect a jam condition for proper recovery.

At least one bumper 70 may optionally be disposed on the apparatus 100 for absorbing a portion of the force of impact of the anvil 62 and/or anvil assembly 60, to reduce wear and tear on the components of the apparatus 100. The at least one bumper 70 may be of an elastic material, for example, and may be disposed on the apparatus 100 at any position where it is capable of absorbing a portion of the force of impact by the piston(s) 42 or the anvil 62. The at least one bumper may be disposed within or outside of a gas spring(s).

A second one-way clutch 58 (shown in FIG. 5, for example) is preferably incorporated into the drive mechanism in order to retain the gas spring(s) in an energized state, although it will be apparent that alternative means of retaining the gas spring or springs in an energized state are possible. This energized state can become the start and stop position for the operational cycle of the apparatus, enabling a much shorter time to fire from cycle start to the driving of a nail. The second one-way clutch 58, will allow the crank to be driven in one direction only. As the crank acts on the anvil assembly, it energizes the gas spring(s). When the motor is thereafter turned off, the second one-way clutch 58 prevents the crank 52 from back driving and keeps the gas spring(s) energized. When the user is ready to fire a nail, the motor is re-energized and the crank continues rotation, releasing the gas spring(s) to drive the nail. To complete, the cycle the crank continues rotation and re-engages the anvil assembly and energizes the gas spring(s). The motor is then turned off and the second one way clutch 58 retains the gas spring(s) in an energized state and ready for the next cycle.

In an embodiment, a sensor 90 may be provided for determining at least one of the position of the crank and/or the anvil and/or anvil assembly upon the anvil to determine whether the anvil and/or anvil assembly is in a state or position to begin another operational cycle or another step of the operational cycle.

In another embodiment of a fastener driving apparatus, safety is enhanced by requiring that a brushless motor be used in conjunction with an anti-reversing mechanism and an intermediate stopping point. This forces the power to connect to the motor to finish the stroke. So although the fastening device would be in a ready or near ready to release position, it would be nearly impossible for the device to release without actuating the motor.

The present disclosure offers the following advantages: the gas springs, mechanical springs and elastomers are capable of generating a relatively high amount of force in a small amount of space such that the size of the apparatus may be smaller than other fastener drivers. Further, because of the relatively small increase from the initial pressure in the gas spring to the maximum pressure, the motor of the apparatus is not significantly overworked or over torqued, thus leading to a longer useful life of the apparatus.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A fastener driving apparatus, the apparatus comprising
a power source,
a control circuit,
a motor,
at least one gas spring, said at least one gas spring comprising a chamber and a piston disposed within said chamber
a drive mechanism, said drive mechanism capable of selectively engaging and disengaging said at least one gas spring, said at least one gas spring capable of moving to an energized position upon being engaged by said drive mechanism, said drive mechanism comprising a one-way clutch,
an anvil assembly, said anvil assembly comprising an anvil, and
at least one cable, said at least one cable operatively coupling said drive mechanism to said anvil assembly,
wherein said drive mechanism selectively engages said gas spring to apply a force on said gas spring to move said piston of said at least one gas spring and thereafter disengages from and ceases applying a force on said at least one gas spring, wherein when said drive mechanism engages said at least one gas spring, potential energy is stored by said movement, and after said one-way clutch causes said drive mechanism thereafter to disengage said at least one gas spring, said at least one gas spring releases its potential energy and accelerates said anvil.

2. The fastener driving apparatus of claim 1, wherein said one-way clutch is one of a sprag clutch, an over running clutch, a roller clutch, a wrap spring, a spindle lock or a ratchet.

3. The fastener driving apparatus of claim 1, the apparatus comprising a second one-way clutch, wherein said second one-way clutch is capable of causing a stopping point during which potential energy is being stored in the at least one gas spring, and wherein the one way clutch retains the drive mechanism and energized at least one gas spring at the stopping point after power is removed from the motor.

4. The cable of claim 1, wherein said at least one cable is comprised of one of wire rope, Kevlar rope, carbon fiber rope, chain, plastic or the like.

5. The cable of claim 1, wherein the cable force is redirected by at least one pulley.

6. The fastener driving apparatus of claim 1, wherein the pressure in said piston of said at least one gas spring before the drive mechanism actuates said at least one gas spring is at least 40 psia.

7. The fastener driving apparatus of claim 1, wherein the pressure increase in said piston of said at least one gas spring during actuation of the at least one gas spring by the drive mechanism is less than 30% of the pressure in said piston is actuated by the drive mechanism.

8. The fastener driving apparatus of claim 1, the apparatus further comprising at least one sensor for determining at least one position of the drive mechanism, the at least one gas spring, the drive mechanism, the anvil, and the anvil assembly.

9. A fastener driving apparatus, the apparatus comprising
a power source,
a control circuit,
a motor,
at least one gas spring, said at least one gas spring comprising a chamber and a piston disposed within said chamber,
an anvil assembly, said anvil assembly comprising an anvil and the piston,
a drive mechanism capable of selectively engaging and disengaging said gas spring, said gas spring capable of moving to an energized position, upon being engaged by said drive mechanism, said drive mechanism comprising a crank and an overrunning clutch, and at least one cable, said at least one cable operatively coupling said crank to said anvil assembly, wherein said drive mechanism comprises an engagement region for engaging and causing said at least one gas spring to move said piston of said gas spring chamber and a non-engagement region for causing said drive mechanism to cease causing said at least one gas spring to so move, said drive mechanism is connected to said crank by said overrunning clutch, wherein potential energy is stored by said movement of said piston, and after said crank passes bottom dead center said overrunning clutch overruns, thereafter disengaging said at least one gas spring, said at least one gas spring thereby accelerating said anvil assembly.

10. The fastener driving apparatus of claim 9, the apparatus comprising a second one-way clutch, wherein said second one-way clutch is capable of causing a stopping point during which potential energy is being stored in the at least one gas spring, and wherein the one way clutch retains the drive mechanism and energized at least one gas spring at the stopping point after power is removed from the motor.

11. The cable of claim 9, wherein said at least one cable is comprised of one of wire rope, Kevlar rope, carbon fiber rope, chain, plastic or the like.

12. The fastener driving apparatus of claim 9, wherein the pressure in said piston of said at least one gas spring before the drive mechanism actuates said at least one gas spring is at least 40 psia.

13. The fastener driving apparatus of claim 9, wherein the pressure increase in said piston of said at least one gas spring during actuation of the at least one gas spring by the drive mechanism is less than 30% of the pressure in said piston is actuated by the drive mechanism.

14. The fastener driving apparatus of claim 9, the apparatus further comprising at least one sensor for determining at least one position of the crank, the at least one gas spring, the drive mechanism, the anvil, and the anvil assembly.

* * * * *